US005345049A

United States Patent [19]

Bahjat et al.

[11] Patent Number: 5,345,049

[45] Date of Patent: Sep. 6, 1994

[54] ELEVATOR SYSTEM HAVING IMPROVED CROWD SERVICE BASED ON EMPTY CAR ASSIGNMENT

[75] Inventors: Zuhair S. Bahjat, Farmington; V. Sarma Pullela, North Granby, both of Conn.

[73] Assignee: Otis Elevator Company, Farmington, Conn.

[21] Appl. No.: 134,517

[22] Filed: Oct. 8, 1993

Related U.S. Application Data

[63] Continuation of Ser. No. 799,506, Nov. 27, 1991, abandoned.

[51] Int. Cl.[5] ..... B66B 1/18; B66B 1/20

[52] U.S. Cl. ..... 187/127; 187/126

[58] Field of Search ..... 187/133, 128, 125, 127

[56] References Cited

U.S. PATENT DOCUMENTS

| | | | |
|---|---|---|---|
| 3,561,571 | 2/1971 | Gingrich | 187/29 |
| 3,891,064 | 6/1975 | Clark | 187/29 R |
| 4,044,860 | 8/1977 | Kaneko et al. | 187/132 |
| 4,193,478 | 3/1980 | Keller et al. | 187/101 |
| 4,299,309 | 10/1981 | Bittar et al. | 187/29 R |
| 4,305,479 | 12/1981 | Bittar et al. | 187/29 R |
| 4,323,142 | 4/1982 | Bittar | 187/29 R |
| 4,363,381 | 12/1982 | Bittar | 187/29 R |
| 4,523,665 | 6/1985 | Tsuji | 187/29 R |
| 4,524,418 | 6/1985 | Araya et al. | 364/436 |
| 4,562,530 | 12/1985 | Umeda et al. | 364/148 |
| 4,672,531 | 6/1987 | Uetani | 364/138 |
| 4,838,384 | 6/1989 | Thangavelu | 187/125 |
| 5,024,295 | 6/1991 | Thangavelu | 187/125 |

FOREIGN PATENT DOCUMENTS

| | | |
|---|---|---|
| 0385810 | 3/1990 | European Pat. Off. . |
| 0385811 | 3/1990 | European Pat. Off. . |
| 0443188 | 8/1991 | European Pat. Off. . |
| 3304044 | 2/1983 | Fed. Rep. of Germany . |

OTHER PUBLICATIONS

Barney, G. C. & Dos Santos, S. M. *Lift-Traffic Analysis Design and Control*, publ. by Peter Peregrinus Ltd., Stevenage, England, pp 85-147.

*Primary Examiner*—Steven L. Stephan
*Assistant Examiner*—Robert Nappi
*Attorney, Agent, or Firm*—Francis J. Maguire, Jr.

[57] ABSTRACT

A method for controlling the dispatching of elevator cars, and apparatus for accomplishing the method. The method includes the steps of (a) receiving a hall call from a floor landing; (b) determining a current passenger load of an elevator car; (c) determining if a crowd signal is generated for the floor landing; and, if it is determined that a crowd signal is generated for the floor landing, (d) determining, from the current passenger load, if the elevator car is EMPTY. If it is determined that the elevator car is EMPTY, the method further includes the steps of (e) assigning an Empty Car Bonus to the elevator car; and (f) employing the Empty Car Bonus value in determining a Relative System Response for the elevator car. The Relative System Response is a function of a plurality of bonuses and penalties. The use of the invention increases the efficiency of the elevator system and serves to decrease the waiting time for persons waiting behind the hall call by increasing the probability of an empty car being assigned to a hall call having a crowd waiting behind the hall call.

4 Claims, 6 Drawing Sheets

ELEVATOR SYSTEM HAVING IMPROVED CROWD SERVICE BASED ON EMPTY CAR ASSIGNMENT

This application is a continuation of commonly owned application Ser. No. 07/799,506, dated Nov. 27, 1991 and now abandon.

REFERENCE TO RELATED PATENT APPLICATIONS

This patent application is related to a commonly assigned U.S. patent application entitled "Elevator System with Varying Motion Profiles and Parameters Based on Crowd Related Predictions" Ser. No. 07/508,319, filed April 12, 1990 by Z. S. Bahjat et al.

TECHNICAL FIELD

This invention relates to elevator systems and, in particular, to a method and apparatus for assigning elevator cars to stop at predetermined floors.

BACKGROUND OF THE INVENTION

Modern elevator systems often include distributed intelligence in the form of elevator car controllers, such as microprocessors.

In such elevator systems, the factors that control the assignment of the elevator cars to service a crowd condition at a given floor do not take into account empty cars that may be available to service the crowd. The factors that are typically taken into account represent a number of car hall stops, proximity of the cars to a hall call, direction of travel of the cars, etc. Although all of these factors are important, they may not represent an optimum set of factors to influence the allocation or assignment of cars to predetermined floors in response to the occurrence of a crowd situation.

In that it is desirable to move the crowd as quickly as possible, it can be appreciated that an already crowded car traveling towards the 'crowd' floor, and stopping to pick up passengers, would be capable of permitting but only a few people to board. However, the already crowded car would still be considered to be one car of a set of cars assigned to pick up the crowd. Thus, not all persons may be enabled to board the assigned cars. This results in a delay in servicing all of the members of the crowd, and non-optimal service for crowded floors from where people may be going to different floors.

In commonly assigned U.S. Pat. No. 5,024,295, issued Jun. 19, 1991 entitled "Relative System Response Elevator Dispatcher System using Artificial Intelligence to Vary Bonuses and Penalties" to K. Thangavelu there is described a microprocessor based group controller that communicates with the elevator cars to assign cars to hall calls based on a relative system response (RSR) approach. Assigned bonuses and penalties are varied using "artificial intelligence" techniques based on combined historic and real time traffic predictions. The system can predict a number of people behind a hall call and, based on average boarding and de-boarding rates, can predict an expected car load at the hall call floor. The stopping of a heavily loaded car to pick up a few people is penalized using a car load penalty. As is stated in Col. 11, when the number of people behind a hall call is predicted, and when the car load is determined, a car load penalty (CLP) is used to penalize the stopping of heavily loaded car, in the absence of a coincident car call stop at the hall call floor. The penalty is variable and increases proportionally to the number of people in a car.

In commonly assigned U.S. Pat. No. 4,323,142, issued Apr. 6, 1982 entitled "Dynamically Reevaluated Elevator Call Assignments" to J. Bittar there is described an elevator control system in which all unanswered hall calls are assigned to elevator cars on a current, dynamic basis, which takes into account actual, current conditions of the system.

In commonly assigned U.S. Pat. No. 4,363,381, issued Dec. 14, 1982, entitled "Relative System Response Elevator Call Assignments" to J. Bittar there is described an elevator system in which hall calls registered at a plurality of landings are assigned to cars on the basis of a summation of relative system response factors for each car relative to each registered hall call, including the factor of whether the car is full or not.

It is an object of this invention to provide an elevator system that employs an empty car bonus, if the car is empty, in calculating an elevator car's relative system response.

It is a further object of this invention to provide an elevator system within which elevator cars having a highest capacity are given a larger weight to increase a likelihood of their assignment to a floor landing having a detected or a predicted crowd condition.

It is one still further object of the invention to determine the presence of a crowd behind a hall call, through a crowd sensor or through a prediction made based upon historical or real time passenger data, and to provide an empty car bonus in assigning elevator cars to the floor landing having the measured or predicted crowd.

SUMMARY OF THE INVENTION

The objects of the invention are realized with a method for controlling the dispatching of elevator cars, and with apparatus for accomplishing the method. The method includes the steps of (a) receiving a hall call from a floor landing; (b) determining a current passenger load of an elevator car; (c) determining if a crowd signal is generated for the floor landing; and, if it is determined that a crowd signal is generated for the floor landing, (d) determining if the current passenger load of the elevator car indicates that the car is EMPTY. That is, if the car contains less than some predetermined passenger load weight. If it is determined that the current passenger load of the elevator car is less than the predetermined passenger load, that is, that the car is EMPTY, the method further includes the steps of (e) assigning an Empty Car Bonus to the elevator car; and (f) employing the Empty Car Bonus value as a factor in determining a Relative System Response for the elevator car. The Relative System Response is a function of a plurality of bonuses and penalties.

If it is determined that the current passenger load of the elevator car is greater than the predetermined passenger load, that is, that the car is not EMPTY, the method includes a step of determining a Car Load Penalty as a function of the determined passenger load.

If it is determined that a crowd signal is not generated for the floor landing, the method includes a step of determining the Car Load Penalty as a function of the determined passenger load.

In one embodiment of the invention, the step of determining if a crowd signal is generated for the floor landing includes an initial step of generating the crowd signal with crowd sensor hardware disposed at the floor landing. In another embodiment of the invention, the step of determining if a crowd signal is generated for the floor landing includes an initial step of generating the crowd signal with a predictive technique based at least in part on a historical record of boarding passengers for the floor landing.

BRIEF DESCRIPTION OF THE DRAWINGS

The foregoing aspects of the invention will be made more apparent in the ensuing Description when read in conjunction with the accompanying drawings, wherein.

DETAILED DESCRIPTION OF THE INVENTION

The disclosure of commonly assigned U.S. Pat. No. 5,024,295, issued Jun. 19, 1991, entitled "Relative System Response Elevator Dispatcher System using Artificial Intelligence to Vary Bonuses and Penalties" to K. Thangavelu, commonly assigned U.S. Pat. No. 4,323,142, issued Apr. 6, 1982, entitled "Dynamically Reevaluated Elevator Call Assignments" to J. Bittar, and commonly assigned U.S. Pat. No. 4,363,381, issued Dec. 14, 1982, entitled "Relative System Response Elevator Call Assignments" to J. Bittar are incorporated herein by reference in their entireties.

Figure 1:
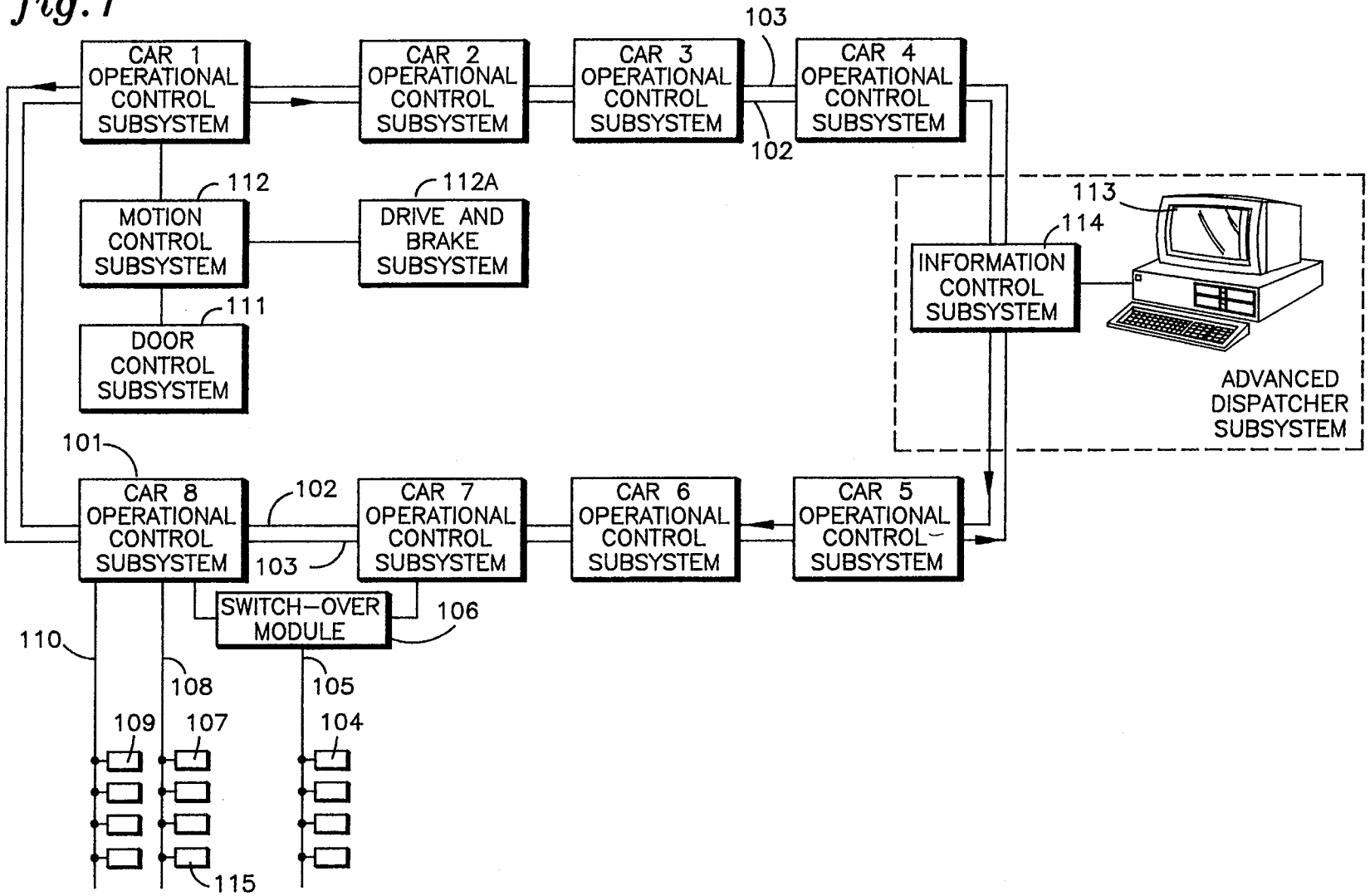
FIG. 1 is a block diagram of an elevator system that is constructed and operated in accordance with the invention.

FIG. 1 is a block diagram that depicts an elevator system of a type described in co-pending and commonly assigned U.S. patent application Ser. No. 07/029,495, entitled "Two-Way Ring Communication System for Elevator Group Control", filed Mar. 23, 1987. This elevator system presents but one suitable configuration for practicing the present invention. As described therein, an elevator group control function may be distributed to separate data processors, such as microprocessors, on a per elevator car basis. These microprocessors, referred to herein as operational control subsystems (OCSS) 101, are coupled together with a two-way ring communication bus (102, 103). For the illustrated embodiment the elevator group consists of eight elevator cars (CAR 1–CAR 8) and, hence, includes eight OCSS 101 units.

For a given installation, a building may have more than one group of elevator cars. Furthermore, each group may include from one to some maximum specified number of elevator cars, typically a maximum of eight cars.

Hall buttons and lights are connected with remote stations 104 and remote serial communication links 105 to each OCSS 101 via a switch-over module (SOM) 106. Elevator car buttons, lights, and switches are coupled through similar remote stations 107 and serial links 108 to the OCSS 101. Elevator car specific hall features, such as car direction and position indicators, are coupled through remote stations 109 and a remote serial link 110 to the OCSS 101.

It should be realized that each elevator car and associated OCSS 101 has a similar arrangement of indicators, switches, communication links and the like, as just described, associated therewith. For the sake of simplicity only those associated with CAR 8 are shown in FIG. 1.

Car load measurement is periodically read by a door control subsystem (DCSS) 111, which is a component of a car controller system. The load measurement is sent to a motion control subsystem (MCSS) 112, which is also a component of the car controller system. The load measurement in turn is sent to the OCSS 101. DCSS 111 and MCSS 112 are preferably embodied within microprocessors for controlling the car door operation and the car motion, under the control of the OCSS 101. The MCSS 112 also works in conjunction with a drive and brake subsystem (DBSS) 112A.

A car dispatching function is executed by the OCSS 101, in conjunction with an advanced dispatcher subsystem (ADSS) 113, which communicates with each OCSS 101 through an information control subsystem (ICSS) 114. By example, the measured car load is converted into boarding and deboarding passenger counts by the MCSS 112 and sent to the OCSS 101. The OCSS 101 subsequently transmits this data over the communication buses 102, 103 to the ADSS 113, via the ICSS 114. Also by example, data from a hardware door dwell sensor mounted on the car's door frame senses boarding traffic, and this sensed information is provided to the car's OCSS 101. This information may used by the OCSS 101, in conjunction with the ADSS 113, to process the information and, as appropriate, vary the door dwell time through the DCSS 111.

As such, it can be seen that the ICSS 114 functions as a communication bus interface for the ADSS 113, which in turn influences high level elevator car control functions.

For example, and as described in detail below, the ADSS 113 may collect data on individual car and group demands throughout the day to arrive at a historical record of traffic demands for different time intervals for each day of the week. The ADSS 113 may also compare a predicted demand to an actual demand so as to adjust elevator car dispatching sequences to obtain an optimum level of group and individual car performance.

By example, between 6:00 AM and midnight, that is for the whole active work day, at each floor in the building and in each traffic direction, the following traffic data is collected for short periods of time, for example, one minute intervals. This traffic data includes (a) the number of hall call stops made, (b) the number of passengers boarding the cars using car load measurements at the floors, (c) the number of car call stops made, and (d) the number of passengers deboarding the cars, again using car load measurements at the floors.

At the end of each interval, the data collected during, for example, the past three intervals at various floors in terms of passenger counts and car stop counts, is analyzed. If the data shows that car stops were made at any floor in any direction in, for example, two out of the three past minutes and, on the average, more than two passengers boarded or two passengers deboarded each car at that floor and direction, during at least two intervals, a real time prediction for that floor and direction is initiated.

A preferred technique, which does not employ a fixed number of boarding or deboarding passengers, detects the presence of significant traffic, or a "crowd", based on some percentage figure of building population or floor population. For example, three percent of floor population is a presently preferred threshold for initiating real time prediction.

The traffic for the next two or three minute intervals for that floor, the direction, and the traffic type (boarding or deboarding) is then predicted, using a prediction algorithm that employs, by example, a linear exponential smoothing model. Both passenger counts and car stop counts (hall call stops or car call stops) are thus predicted.

The real time prediction is terminated when, during at least two intervals, the number of boarding or deboarding passengers falls below some percentage of the floor population or the building population. A presently preferred threshold is one percent. A fixed number of boarding or deboarding passengers, as opposed to a percentage, could also be employed.

That is, three percent of floor population is generally indicative of a crowd, or a trend towards a crowd condition, so as to initiate historical data collection. Also, when traffic falls below one percent of floor population, the historic data collection may be terminated.

Whenever significant traffic levels are observed at a floor in a given direction and real time traffic predictions are made, the real time collected data for various intervals is saved by the ADSS 113 in a historic data base. The floor where the traffic was observed, the traffic direction, and the type of traffic, in terms of boarding or deboarding counts, hall call stops, or car call stops, are recorded in the historic data base. The starting and ending times of the traffic and the day of the week are also recorded.

The data saved during the day in the historic data base is compared against the data from the previous days. If the same traffic cycle repeats each working day within, for example, a three minute tolerance of starting and ending times and, for example, a fifteen percent tolerance in traffic volume variation during the first four and last four short intervals, the current day's data is saved in a normal traffic patterns file.

If the data does not repeat on each working day, but if the pattern repeats on each same day of the week within, for example, a three minute tolerance of starting and ending times and, for example, a fifteen percent tolerance in traffic volume variation during the first four and last four intervals, the current day's data is saved in a normal weekly patterns file. The same is true for establishing a daily traffic pattern.

After the data collected during the day is thus analyzed and saved in the normal patterns file and/or the normal weekly patterns file, all the data in those files for various floors, directions, and traffic types is used to predict traffic for the next day. For each floor, direction, and traffic type, the various occurrences of historic patterns are identified one by one. For each such occurrence, the traffic for the next day is predicted using the data at the previous occurrence and the predicted data at the last occurrence, using a prediction algorithm such as an exponential smoothing model. All normal traffic patterns and normal weekly traffic patterns expected to be occurring on the next day are thus predicted and saved in the current days historic prediction data base.

At the end of each data collection interval, the floors and directions where significant traffic has been observed are identified. After the real time traffic for the significant traffic type has been predicted, the current day's historic prediction data base is checked to identify if historic traffic prediction has been made at this floor and direction for the same traffic type for the next interval. The historic prediction includes both weekly and daily traffic patterns.

If so, then the two predicted values are combined to obtain optimal predictions. These predictions give weight to historic and real time prediction and hence employ a weighing factor of some percentage for all types of predictions. If however, once the traffic cycle has started, the real time predictions differ from the historic prediction (weekly and daily) by more than, for example, twenty percent in, for example, four out of six one minute intervals, the real time prediction is given a weight of, for example, three-quarters and the historic prediction a weight of one-quarter to arrive at a combined optimal prediction. By example, $$\text{prediction} = x(\text{Real time}) + y(\text{Weekly Prediction}) + z(\text{Daily Prediction}),$$

where x, y, and z are weighting factors.

If no historic predictions have been made at that floor for the same direction and traffic type for the next few intervals, the real time predicted passenger counts and car counts for the next three or four minutes are used as the optimal predictions.

Using this predicted data, the passenger boarding rate and deboarding rate at the floor where significant traffic occurs are then calculated. The boarding rate is calculated as the ratio of total number of passengers boarding the cars at that floor in that direction during that interval to the number of hall call stops made at that floor, in that direction, and during the same interval. The deboarding rate is calculated as the ratio of number of passengers deboarding the cars at that floor, in that direction, and in that interval, to the number of car call stops made at that floor, in that direction, and in the same interval.

The boarding rate and deboarding rate for the next three to four minutes for the floors and directions where significant traffic is observed are thus calculated once a minute. If the traffic at a floor and a direction is not significant, i.e., less than, for example, some percentage of the floor population boarding or deboarding the car, the boarding or deboarding rates are not calculated.

Figure 3A:
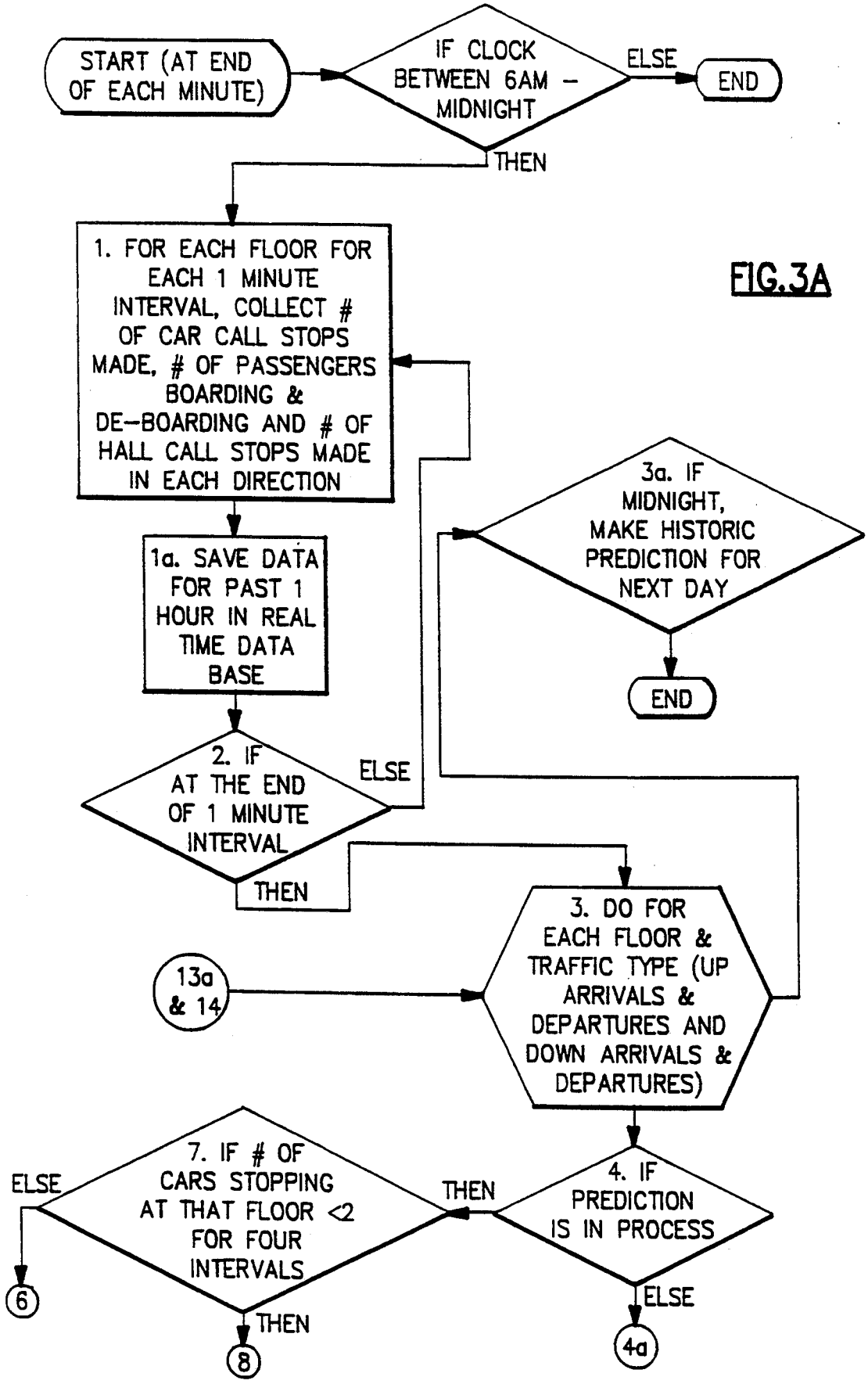
FIGS. 3A and 3B, in combination, illustrate a logic flow diagram of a method used to collect and predict traffic and passenger boarding and de-boarding rates at various floors.
Figure 3B:
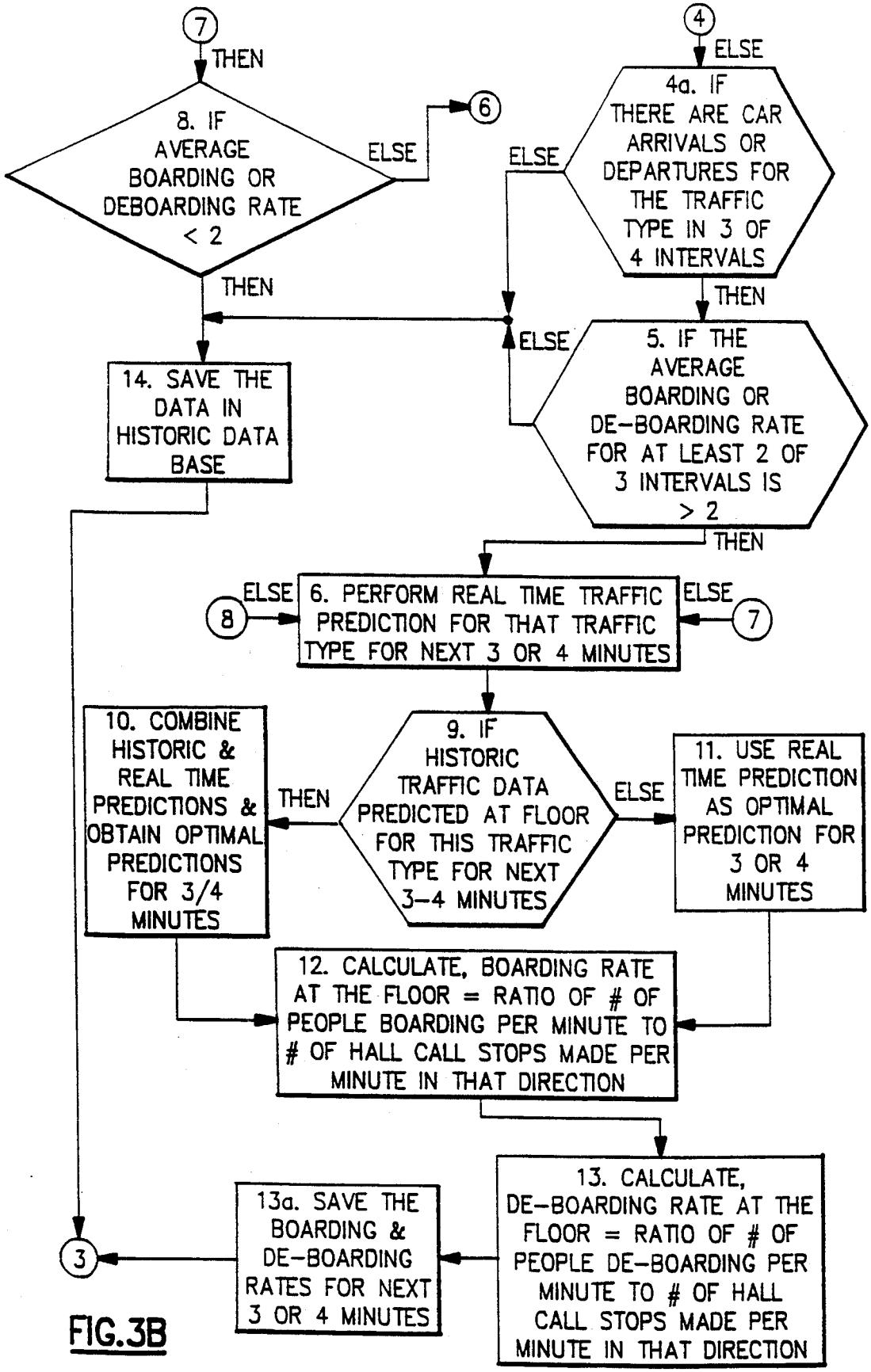

As a particular example of the foregoing, and used as an exemplary embodiment of a crowd prediction method for use with the present invention, the flow diagram illustrated in combined FIGS. 3A and 3B collects and predicts traffic and computes boarding and de-boarding rates. In steps 3-1 and 3-2 the traffic data is collected for, by example, each one minute interval during an appropriate time frame covering at least all of the active work day, for example, from 6:00 AM until midnight, in terms of the number of passengers boarding the car, the number of hall call stops made, the number of passengers deboarding the car, and the number of car call stops made at each floor in the "up" and "down" directions. The data collected for, by example, the latest one hour is saved in the data base, as generally shown in FIGS. 4A and 4B and in step 3.

In steps 3-3 to 3-4*a*, at the end of each minute the data is analyzed to identify if car stops were made at any floor in the "up" and "down" direction in, for example, two out of three one minute intervals and, if on the average more than, for example, two passengers de-boarded or boarded each car during those intervals. If so, significant traffic is considered to be indicated.

The traffic for, by example, the next three to four minutes is then predicted in step 3-6 at that floor, and for that direction, using real time data and, preferably, a linear exponential smoothing model. One suitable model is described by Makridakis & Wheelwright in *Forecasting Methods and Applications* (John Wiley & Sons, Inc. 1978), particularly Section 3.6 entitled "Linear Exponential Smoothing". Thus, if the traffic "today" varies significantly from the previous days traffic, this variation is taken into consideration when making predictions.

If this traffic pattern repeats each day or each same day of the week at this floor, the data is stored in the daily prediction data base.

If such a prediction is available, the historic and real time predictions are combined to obtain optimal predictions in step 3-10. The predictions can combine both the real time predictions and the historic predictions in accordance with the following relationship:

$$X = ax_D + bx_W + cx_R,$$

where "X" is the combined prediction, "$x_D$" is the daily prediction, $x_W$ is the weekly prediction, and "$X_R$" is the real time prediction for a time period for the floor, and "a", "b", and "c" are coefficient factors. The coefficient factors may be varied as a function of how closely the actual traffic matches the predicted traffic.

If historic predictions are not available, real time prediction is used for the optimal predictions, as shown in step 3-11.

As can be seen in the figures, other detailed steps or features are included in the method of FIGS. 3A and 3B, and are considered to be self-explanatory in view of the foregoing.

Next, for each floor and direction where significant traffic has been predicted in step 3-12, the average boarding rate is calculated as, for example, the ratio of the predicted number of people boarding the car during the interval to the number of hall call stops made in that interval. The average de-boarding rate is computed in step 3-13 as the ratio of the predicted number of people de-boarding the car during an interval to the number of car call stops made in that interval. These rates are calculated for the next three to four minutes and saved in the data base maintained by the ADSS 113.

Figure 4:
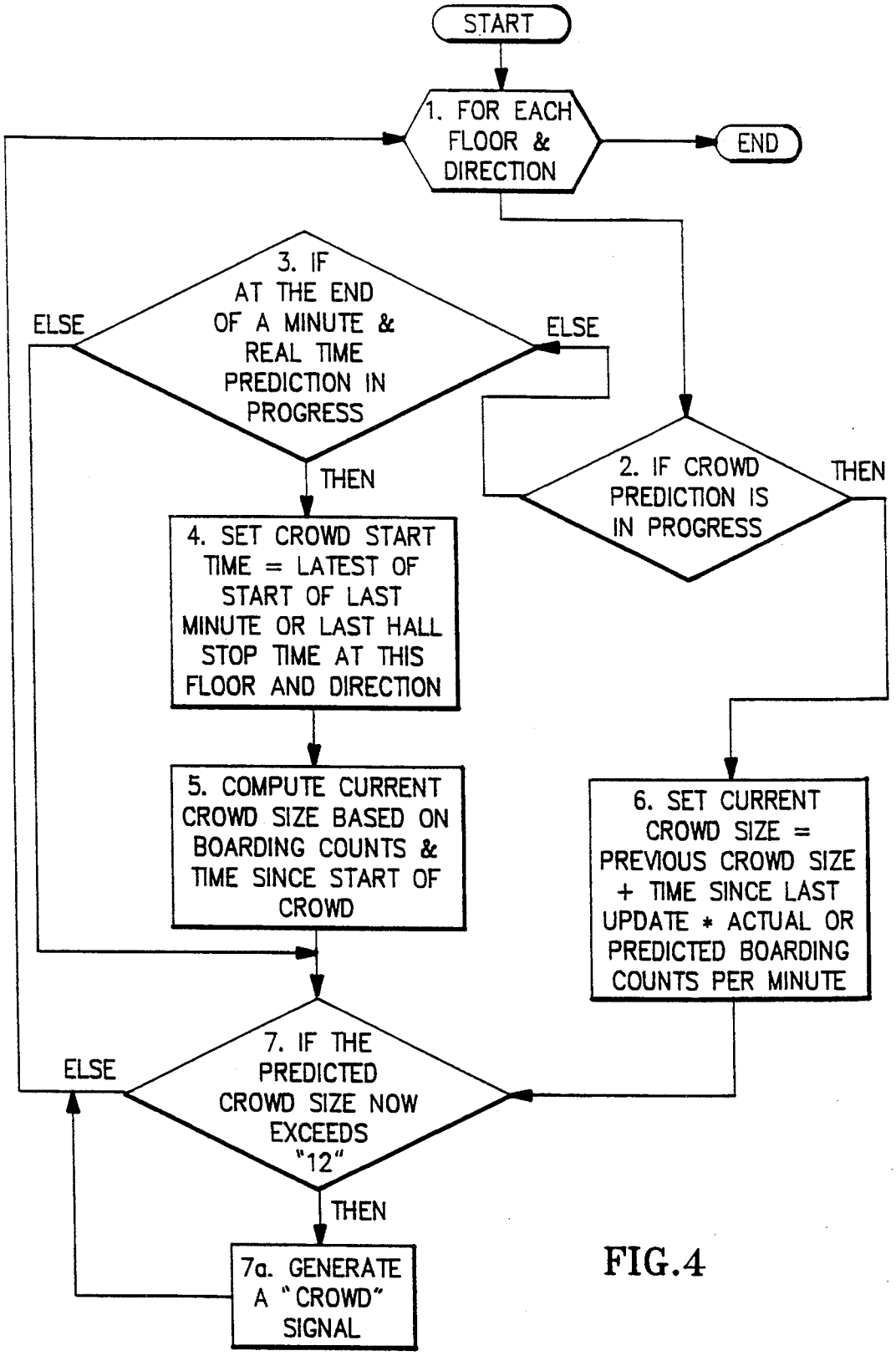
FIG. 4 is a logic flow diagram of a method used to determine crowd size at the floors at the end of fifteen second intervals.

Reference is now made to the logic flow diagram of FIG. 4 which illustrates an exemplary methodology to predict a crowd at the end of, for example, each fifteen second interval (or other appropriate programmable interval).

The crowd prediction method of FIG. 4 is executed periodically once every, by example, fifteen seconds. This algorithm checks each floor and direction and determines if crowd prediction is in progress for that traffic (steps 4-1 and 4-2). If not, in step 4-3, if at the end of a minute and if a real time traffic prediction has been made for that call (so significant traffic has been observed during the past several minutes), then in step 4-4 the crowd start time is set at the latest of the start of the last minute or the last time a car stopped for a hall call at this floor and direction. Then, in step 4-5, using the past minutes predicted boarding counts, the predicted "crowd" (until the current time) is computed as the product of crowd accumulation time and passenger boarding count per minute.

If in step 4-2 the crowd prediction is in progress, then the last time when a "crowd" was predicted may be fifteen seconds before or may be the last time a car stopped for a hall call at this floor and picked up passengers. Thus, in step 4-6 the current crowd size is determined using the time since the last crowd update and the actual or predicted boarding counts per minute.

In step 4-7, if the predicted crowd size now exceeds, for example, twelve people, a "crowd signal" is generated in step 4-7*a*. This crowd signal is transmitted from the ADSS 113, via the ICSS 114 and the ring communication bus (102, 103), to each OCSS 101 of the elevator group.

Figure 5:
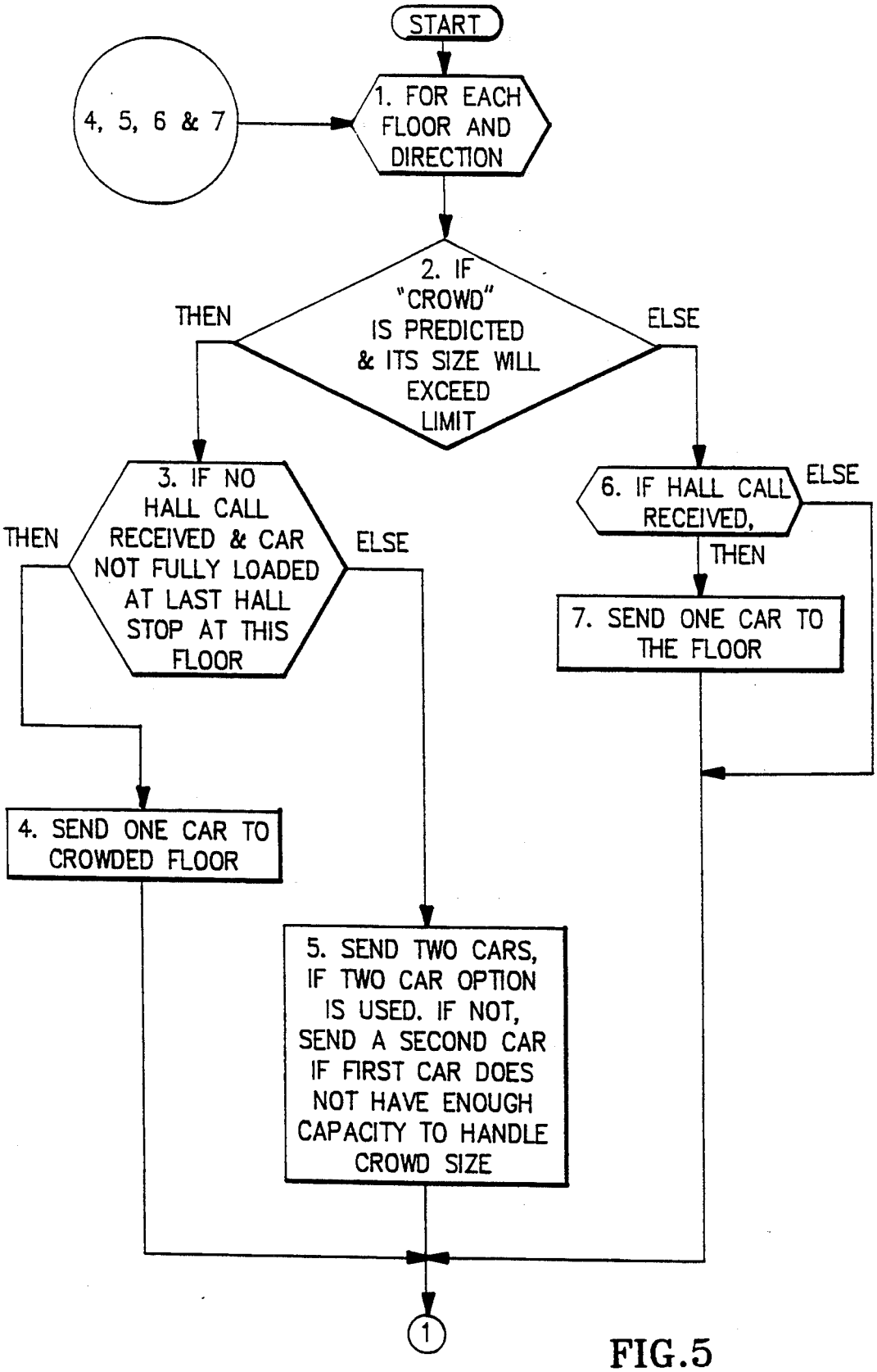
FIG. 5 is a logic flow diagram of a method used for car assignment to serve crowded floor(s) in which one or more cars are assigned for each of the crowded floor(s).

FIG. 5 illustrates one method for selecting one or more cars for the crowded floor(s). For each floor and direction (step 5-1), a check is made in step 5-2 to determine if a crowd was predicted and if this size will exceed a "crowd limit", for example twelve persons (or some suitable percentage of building or floor population). If a crowd was predicted at a floor for a direction, then in step 5-3, if no hall call has been received from that floor in that direction, a decision is made in step 5-4 to assign one car to that floor and direction, if no car stopped for a hall call at that floor and direction during the past, for example, three minutes, or if a car which stopped for a hall call at that floor and direction was partially loaded when it closed its doors. However, if a car stopped at that floor and direction within the past three minutes and left the floor fully loaded, in step 5-5 a decision is made to assign two cars for that floor and direction, if a "two car options" is used; if not, one car will be sent if it has sufficient spare capacity to accommodate the currently predicted crowd. If the car does not have enough capacity, two cars are sent to that floor and direction.

If a hall call is received from the floor for the direction for which a crowd is predicted, two cars are sent if the "two car option" is used. If not, the decision to send only one car or two cars will depend on if the first car has sufficient spare capacity to accommodate the currently predicted crowd.

If in step 5-6 a hall call is received from a floor, but no crowd has been predicted in step 5-2, one (note step 5-7) or two cars as assigned to the hall call, as described in the above referenced and commonly assigned U.S. Pat. No. 5,024,295, issued Jun. 19, 1991, entitled "Relative System Response Elevator Dispatcher System using Artificial Intelligence to Vary Bonuses and Penalties" to K. Thangavelu.

If a cyclical car assignment to hall calls is executed at intervals greater than one second, then whenever the crowd prediction method predicts a "crowd" at any floor, it is followed by the method to select one or more cars for the crowded floors. The appropriate car assignment method is executed, and the cars assigned to crowded floors and hall calls.

When a car assigned to a crowded floor reaches that floor's commitment point, the car decelerates to the floor if a hall call is pending at that floor or if the car is empty, allowing the car to be parked at that floor, or if the last car that stopped for a hall call in that direction left the floor fully loaded. When the car reaches the crowd floor and opens the doors, if there were no passengers boarding the car, and if the car was empty, the car will park at that floor, if there is no traffic at that time, and thus wait for the arrival of the predicted crowd.

If, when the car reaches the crowded floor, the car is not empty and does not become empty, then when it closes the door, it sends its passenger boarding counts to the other cars of the elevator group. If the car was partially loaded, the crowd size is reset to zero, assuming all passengers waiting for the car have boarded the car. In response, the crowd prediction method updates the crowd size from this zero condition. If, on the other hand, the car was fully loaded when it closed its doors, the crowd size is updated by adding the estimated arrivals since the last crowd update and then subtracting the boarding counts for this car.

If the crowd size was set to zero, then if another car has also been assigned to this floor for crowd service, its assignment is canceled. If the crowd size is not zero, but does not exceed the crowd limit, the car currently on its way to this floor maintains its assignment.

When a hall call exists for the crowd floor, the crowd size is predicted for the next call entered. If the crowd size exceeds the "crowd limit" and if the previous car was fully loaded, a decision is made to send two cars to this floor if the "two car option" is used, or if the spare capacity in the first car cannot handle the crowd predicted. If the car that left the floor previously was only partially loaded, only one car is sent to this floor if a crowd condition is predicted.

The foregoing methods, described also in the above mentioned commonly assigned U.S. patent application entitled "Elevator System with Varying Motion Profiles and Parameters Based on Crowd Related Predictions" Ser. No. 07/508,319, filed Apr. 12, 1990 by Z. S. Bahjat et al, dynamically keep track of passenger queue build up and dissipation. Cars are dispatched to crowd floors before a hall call is registered, if a crowd is predicted. Also, multiple cars are dispatched to a crowd floor, if a hall call is received from the floor, or if the car that stopped previously at this hall call floor left fully loaded.

A variation of this method selects more than two cars if the size of the predicted crowd is such that the two successive cars selected by the car assignment method do not have the capacity to accommodate the predicted traffic and if the excess number of passengers exceeds some minimum count, for example five passengers.

Since the traffic data is predicted separately for the "up" and "down" directions, the crowd prediction is also done separately based on the predicted traffic levels for these directions. Thus, the same method is applicable whether the crowd traffic goes up, down, or in both directions.

It should be understood that, with respect to historic data, the references made above to the "next day" refer to the "next normal day" and references to the past "several days" refer to the previous several "normal", or work days, all typically involving a working weekday. Thus, for example, weekend days (Saturdays and Sundays) and holidays will not have meaningful or true peak periods and are not included in the peak period strategies, and their data does not appear in the recorded historic data, unless in fact peak periods do also occur on those days.

Having thus described exemplary methods of predicting the presence of a crowd at a particular floor, a description will now be provided of a hardware crowd sensing system.

In accordance with an aspect of the invention the elevator system further includes a mechanism for detecting a presence of a crowd condition at a floor landing. This mechanism may be embodied within a hardware crowd sensor 115 that is coupled to each OCSS 101, and/or through a central intelligent processor, such as the ADSS 113, that has the aforedescribed artificial intelligence logic to predict a number of people boarding and deboarding at each floor for both up and down direction for determined intervals throughout the day.

The hardware crowd sensor(s) 115, if present, have the capability to detect a crowd at a floor landing. As employed herein, a crowd is considered to be a group of people having a number that equals or exceeds a predetermined threshold number, such as 12. Crowd sensing may be accomplished with, by example, ultrasonic transducers, infrared transmitters and detectors, proximity or weight sensors embedded within the floor, or through a combination of such techniques. By example only, a plurality of infrared transmitter and receiver pairs are strategically positioned to provide coverage of an area at the elevator floor landing where waiting passengers congregate. If there are (m) transmitter and receiver pairs, and if (n) pairs experience a blockage of the beam transmitted between the transmitter and the receiver due to the presence of waiting passengers, where $(n) \leqq (m)$, then a crowd condition is considered to be detected and is signalled for the landing. Each OCSS 101 receives inputs from each crowd sensor from each floor. By example, if there are three sensors per car, per floor (where crowds are to be detected), and if there are five cars, then there are three inputs per car and 15 inputs for the entire group.

The OCSS 101, as soon as it detects a hall signal from a floor, and if it has detected a crowd signal (whether from the hardware sensors 115 or from the ADSS 113), assigns to itself an EMPTY car bonus (ECB), if it is EMPTY. The ECB is then used in calculating the cars' RSR. If the car is partially loaded, it instead employs a loaded car penalty that increases with load in the car. The cars with the highest capacity (as EMPTY as possible) are hence given larger logical weight so as to increase the likelihood of their assignment to the crowd floor.

Figure 2:
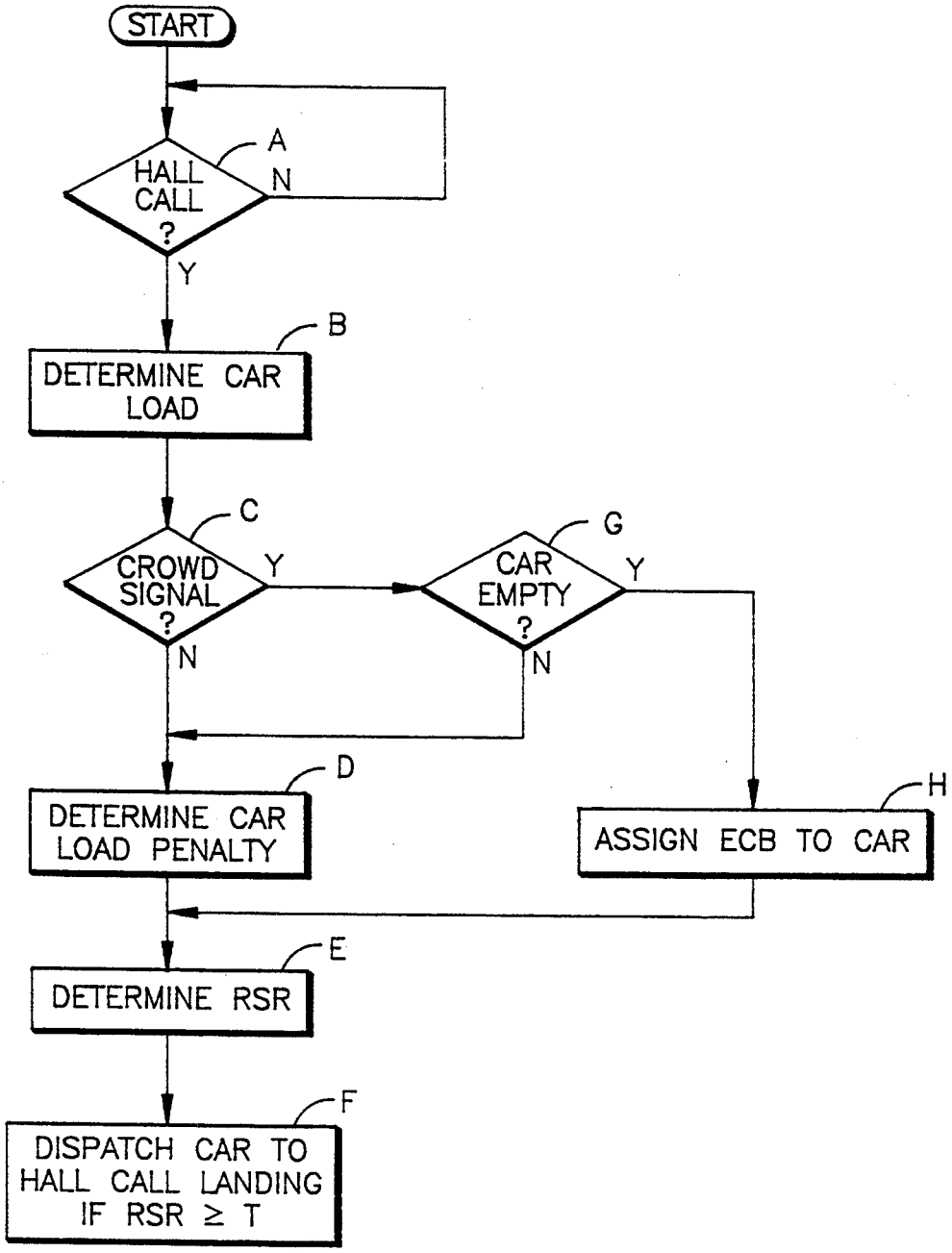
FIG. 2 is a logic flow diagram that illustrates a method of the invention for assigning an Empty Car Bonus to an elevator car.

More specifically, and referring to the logic flow diagram of FIG. 2, at Block A a determination is made by an OCSS 101 if a hall call has been registered. If YES, a determination is made of the car loading. This is accomplished in a conventional manner, such as by determining a total weight of the car, subtracting the weight due to the car itself, and dividing the remainder by some predetermined number representative of an average passenger weight. One suitable value for average passenger weight is 150 pounds. At Block C a determination is made if a crowd signal has been generated for the landing from which the hall call originated. The crowd signal may be generated by the hardware sensor 115 and/or by the predictive approach described in detail above. If the result of Block C is NO, at Block D the car load penalty is determined. This determination may be accomplished as in the aforementioned commonly assigned U.S. Pat. No. 5,024,295, issued Jun. 19, 1991, entitled "Relative System Response Elevator Dispatcher System using Artificial Intelligence to Vary Bonuses and Penalties" to K. Thangavelu. After determining the car load penalty the Relative System Response (RSR), which is based on a plurality of penalties and bonuses, is determined at Block E. At Block F the car is dispatched to answer the hall call if the determined RSR is equal to or greater than some threshold (T) value.

At Block C, if the result of the determination of the presence of the crowd signal is YES, a further determination is made at Block G if the car is EMPTY. That is, based on the determination of car load at Block B, it is determined if the car presently contains no passengers or if the car contains, at most, one passenger. This is accomplished by comparing the car load to some predetermined threshold, such as 300 pounds. If the result of this determination is NO, that is, if the car contains at least two or more passengers, Block D is executed to determine the car load penalty as described above.

As employed herein, a car is considered to be EMPTY if the total passenger weight is less than some predetermined threshold, such as 300 pounds. It should be realized that in other embodiments of the invention that the threshold may be other than 300 pounds. For example, if the threshold were set between 301 pounds and 450 pounds then the presence of two passengers, of average weight, would be considered to be an EMPTY car. If the threshold were set at 150 pounds, then the car would need to contain no passengers, of average weight, in order to be considered an EMPTY car.

If at Block G it is determined that the car is EMPTY, the Empty Car Bonus (ECB) is assigned to the car. The ECB has a relatively large value, by example 200. That is, the ECB has a value that will be considered significant during the car assignment determination procedure. The method then returns to Block E where the RSR is determined. During the RSR determination the presence of the large ECB increases the probability that the EMPTY car will be assigned or dispatched to answer the hall call at the floor having the detected or predicted crowd condition. The use of the invention increases the efficiency of the elevator system and serves to decrease the waiting time for the persons waiting behind the hall call by increasing the probability of an EMPTY car being assigned to a hall call having a crowd waiting behind the hall call.

It should be noted that the ECB is but one of a number of penalties and bonuses which are considered during the RSR determination. By example, in FIG. 7 of the aforementioned commonly assigned U.S. Pat. No. 5,024,295, issued Jun. 19, 1991, entitled "Relative System Response Elevator Dispatcher System using Artificial Intelligence to Vary Bonuses and Penalties" to K. Thangavelu, there is shown a typical variation of the Car Load Penalty, and also a typical variation of a Spare Capacity Bonus, with the car load and the number of people waiting behind a hall call.

Although described in the context of a specific embodiment, it should be realized that a number of modifications may be made thereto. For example, in FIG. 2 certain of the steps may be executed in other than the order shown while still achieving the same result. Also, the particular times and other parameters set forth in FIGS. 3*a*, 3*b*, and 4 are exemplary and are not to be construed as a limitation on the practice of the invention. By example, the number 12 in step 7 of FIG. 4 may be some other suitable value. Furthermore, the invention may be practiced with elevator systems having different architectures than that specifically shown in FIG. 1. Thus, the invention is not intended to be limited to only the illustrated embodiment, but is instead intended to be limited only as the invention is set forth in the claims which follow.

What is claimed is:

1. A method of controlling the dispatching of elevator cars, comprising the steps of:
   - receiving a hall call from a floor landing;
   - determining a current passenger load of an elevator car and generating a current passenger load signal;
   - determining if a crowd signal is generated for the floor landing;
   - if it is determined that a crowd signal is generated for the floor landing
   - determining, by comparing the current passenger load signal with a threshold, if the elevator car is EMPTY;
   - if it is determined that the elevator car is EMPTY, generating an EMPTY car signal;
   - assigning an EMPTY Car Bonus of fixed value to the EMPTY elevator car responsive to the EMPTY car signal;
   - determining a penalty value corresponding to the current passenger load signal;
   - employing the EMPTY Car Bonus of fixed value and the penalty value in determining a Relative System Response signal for the EMPTY elevator car, the Relative System Response signal being a function of a plurality of bonuses and penalties; and then dispatching the EMPTY elevator car to the floor landing responsive to the Relative System Response signal if the car is EMPTY and if the crowd signal is generated.

2. Apparatus for controlling the dispatching of elevator cars, comprising:
   - means for generating a crowd signal in response to a predetermined number of people waiting behind or expected to wait behind an elevator hall call; and
   - for each elevator car,
   - means for receiving a hall call from a floor landing;
   - means for determining a current passenger load of the elevator car;
   - means for determining if the crowd signal is generated for the floor landing, said means including an electronic computer electronically connected to said means for generating a crowd signal;
   - means, responsive to the presence of the crowd signal, for determining, by comparing the current passenger load of the elevator car with a threshold, if the elevator car is EMPTY;
   - means for determining a penalty value dependent upon the current passenger load;
   - means, responsive to the presence of the crowd signal and to a determination that the elevator car is EMPTY, for assigning an EMPTY Car Bonus of fixed value to the EMPTY elevator car; and means for causing a car dispatch signal to be generated for commanding the EMPTY elevator car to be dispatched to the floor landing notwithstanding said penalty value if said EMPTY Car Bonus of fixed value is assigned to the EMPTY elevator car.

3. A method of controlling the dispatching of elevator cars, comprising the steps of:
   - receiving a hall call from a floor landing;
   - generating a current passenger load signal for an elevator car;
   - generating a crowd signal for the floor landing;

generating, by comparing the current passenger load signal with a threshold signal, an EMPTY car signal if the elevator car is EMPTY;

generating an EMPTY Car Bonus of fixed value for the EMPTY elevator car responsive to the EMPTY car signal;

generating from the current passenger load signal a penalty value for the EMPTY elevator car;

employing the Empty Car Bonus of fixed value and the penalty value in generating a Relative System Response signal for the EMPTY elevator car;

generating a car dispatch signal responsive to the Relative System Response signal; and then dispatching the EMPTY elevator car to the floor landing responsive to the car dispatch signal.

4. A method as claimed in claim 3, wherein said step of generating, by comparing the current passenger load signal with a threshold signal, an EMPTY Car Signal if the elevator car is EMPTY, includes determining the elevator car as EMPTY if the elevator car contains no passengers.

* * * * *